US005433051A

United States Patent [19]

Johansson

[11] Patent Number: 5,433,051

[45] Date of Patent: Jul. 18, 1995

[54] SUPPORTING ELEMENT FOR USE IN CASTING CONCRETE FLOORS

[75] Inventor: Lennart Johansson, Mariestad, Sweden

[73] Assignee: Combiform Aktiebolag, Mariestad, Sweden

[21] Appl. No.: 117,041

[22] PCT Filed: Mar. 9, 1992

[86] PCT No.: PCT/SE92/00142

§ 371 Date: Sep. 7, 1993

§ 102(e) Date: Sep. 7, 1993

[87] PCT Pub. No.: WO92/16701

PCT Pub. Date: Oct. 1, 1992

[30] Foreign Application Priority Data

Mar. 13, 1991 [SE] Sweden ..... 9100759

[51] Int. Cl.[6] ..... E04B 2/00

[52] U.S. Cl. ..... 52/367; 52/371

[58] Field of Search ..... 52/367, 372, 371, 364, 52/730.2, 720, 731.7, 731.8, 731.9, 731.1

[56] References Cited

U.S. PATENT DOCUMENTS

| | | | |
|---|---|---|---|
| 1,110,369 | 9/1914 | Bagnall et al. | 52/371 |
| 2,156,027 | 4/1939 | Preble | 52/367 X |
| 2,679,156 | 5/1954 | McFarland | 52/371 |
| 3,222,040 | 12/1965 | Eckert | 52/720 X |
| 3,295,268 | 1/1967 | Gaither | 52/371 X |
| 4,909,002 | 3/1990 | Clifton et al. . | |

FOREIGN PATENT DOCUMENTS

| | | | |
|---|---|---|---|
| 2482646 | 11/1981 | France | 52/364 |
| 461671 | 3/1990 | Sweden . | |
| WO84/00044 | 1/1984 | WIPO . | |
| WO88/09853 | 12/1988 | WIPO . | |
| WO90/03478 | 4/1990 | WIPO . | |

*Primary Examiner*—Lanna Mai

*Attorney, Agent, or Firm*—Nixon & Vanderhye

[57] ABSTRACT

A supporting element for use in casting concrete floors on a foundation includes a base member and a distinct top member supported by the base member. The top member has an elongated top sliding plane surface allowing a concrete leveling device to be moved along it. The base member is typically formed of side walls with openings in them, each making approximately the same angle with respect to the top member and being inclined so that they form an angle of about 25°-90° with respect to each other. The base member may form a groove in a central top portion of it, and the top member may be an elongated rail received within the groove. Foot portions connected to the side walls may have level adjustment screws provided in them for adjusting the position of the top sliding plane surface. A flexible barrier may be disposed in the longitudinal volume between the side walls, and clamp elements may engage opposing foot portions to hold the side walls in a predetermined position with respect to each other.

22 Claims, 3 Drawing Sheets

SUPPORTING ELEMENT FOR USE IN CASTING CONCRETE FLOORS

The present invention relates to a supporting element with elongate form for use in casting concrete floors on a foundation, said support element comprising a base member and a top member with a sliding plane surface to allow a concrete-levelling device carried by the supporting element to be moved along the sliding plane surface.

Known supporting elements of the type described in the introduction consist of beam-like bodies of reinforced concrete, the sliding plane surface thereof usually having a width of 2.5–7 cm. The concrete beams are casted-in to form a part of the finished concrete floor so that the sliding plane surface will be on a level with the surface of the finished concrete floor. A drawback with such casted-in concrete beams is that cracks appear first along one side of the top of the beam and then along the other side. After some years the top of the beam and its sliding plane surface are damaged or destroyed entirely or partly and expensive repair work is necessary. Furthermore, the damages on the top of the beam is accelerated by the trussing irons inside. The grade of concrete used for manufacturing the beams is extremely important. When using such concrete beams, the application of a covering layer is limited as well as securing the trussing irons. Furthermore, the concrete beams can only be used for casting concrete floors on the ground. On other foundations such as ceilings there is insufficient cohesion between fresh and solidified concrete since the concrete beam separates them. In foundations formed of casettes, i.e. prefabricated joist frames of concrete, steel or light concrete, problems may arise with the adhesion between concrete beam and casette. Another problem is that levelling of the concrete beams is relatively time-consuming and complicated since the beams are heavy and are positioned in fresh concrete which must solidify before casting can be performed. Furthermore, handling of the concrete beams during manufacture, storage at the factory, transportation, storage at the retailer and on site, is relatively expensive due to their fragility and high weight.

The object of the present invention is to provide a supporting element which greatly reduces the above-mentioned problems; which has low weight and is thus easily handled; which can be quickly and easily levelled ensuring that the sliding plane surface is at the desired level; which reduces the risk of cracks in the finished concrete floor; which allows great freedom in mounting trussing irons; and which is not limited to casting on the ground but can also be used when casting casettes and ceilings.

The invention is characterized substantially in that the supporting element comprises two longitudinal, form stable side walls defining between them a longitudinal space, and that at least one of the side walls is provided with a plurality of through-holes disposed to permit fresh concrete to flow through into said space during said casting, so that the space is filled with concrete.

The invention will be described further in the following, with reference to the accompanying drawings.

Figure 1:
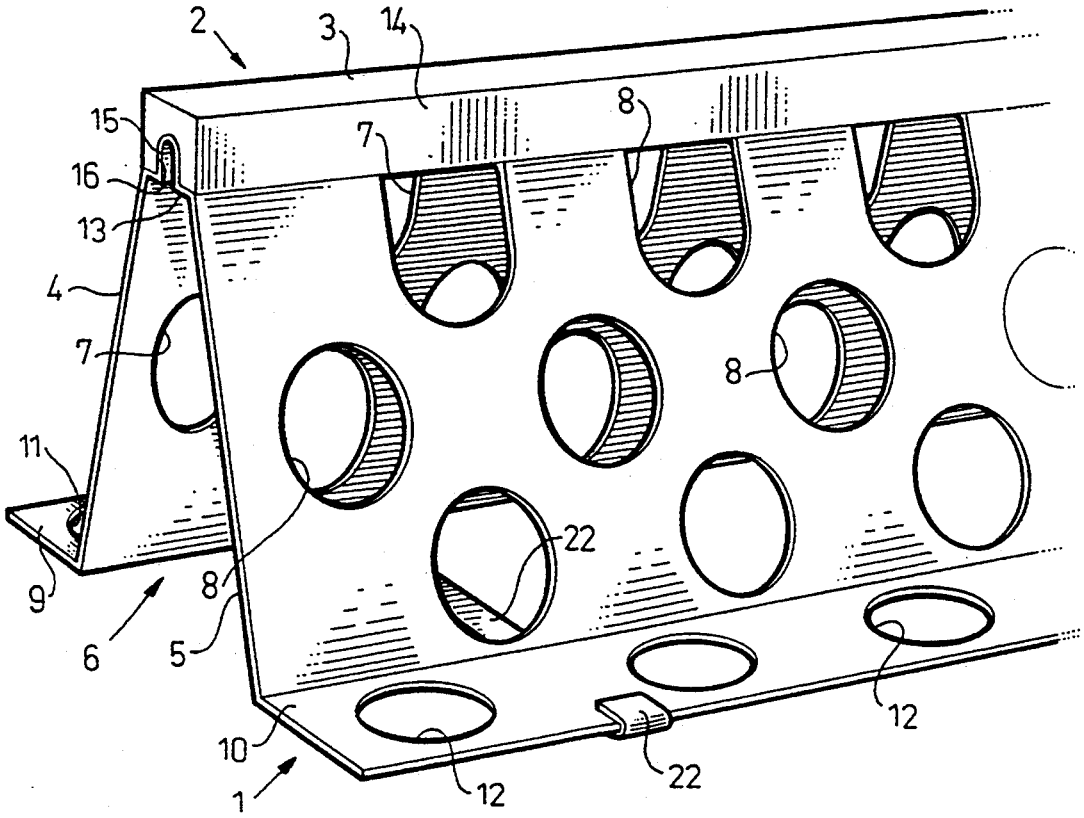
FIG. 1 is a perspective view of a supporting element according to a first embodiment of the invention.
Figure 2:
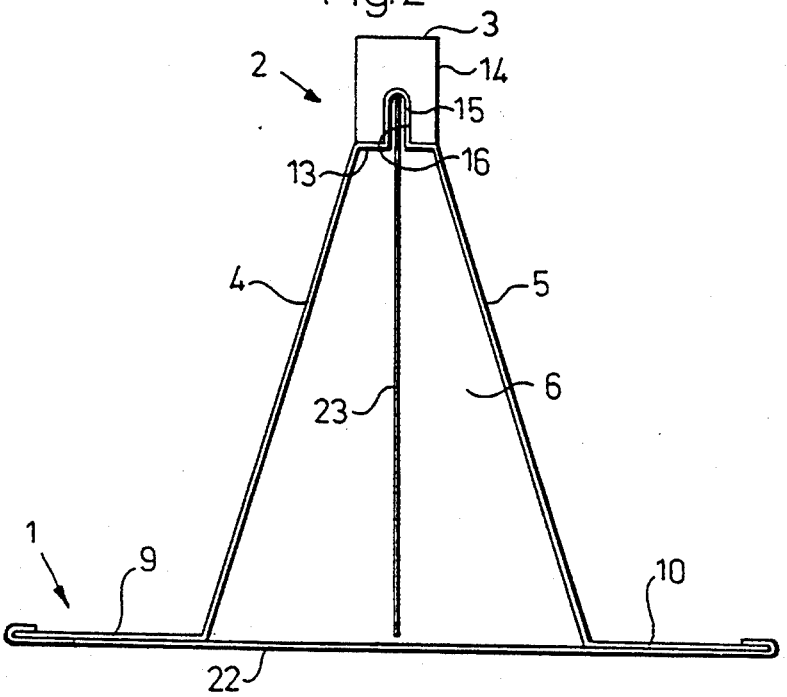
FIG. 2 is an end view of the supporting element according to FIG. 1.

The supporting element shown in FIGS. 1 and 2, generally denoted screed, has an elongate, rail-like form and comprises a base member 1 intended to face downwardly to the foundation on which a concrete floor is to be casted, and a top member 2 having an upwardly facing sliding plane surface 3 on which a concrete-levelling device is intended to rest in order to slide on along said surface 3 when being moved along the supporting element. According to the present invention the supporting element comprises two longitudinal, form stable, i.e. rigid side walls 4, 5 which, seen in a cross section of the supporting element, extend between the top member 2 and the base member 1. Between them the side walls 4, 5 define a free space 6, which extends continuously between the ends of the supporting element. According to the present invention each side wall 4, 5 is provided with a plurality of through-holes 7, 8 distributed evenly across the entire side wall in a plurality of horizontal rows. Each hole, 7, 8 is sufficiently large to permit fresh concrete to flow freely through the side walls into the space 6 and collect therein, and the number of openings 7, 8 is sufficient and their distribution so even that their entire space 6 will be filled with concrete when the supporting element lies embedded in the concrete, before the concrete has had time to solidify. The expression "form stable side walls" means that the walls are sufficiently strong to bear the weight of said concrete-levelling device without becoming deformed.

In the embodiment shown in FIGS. 1 and 2 the side walls 4, 5 are inclined in relation to each other so that they form an acute angle with each other. Within the top member 2 the side walls 4, 5 are firmly connected together to form a form stable unit. The base member 1 comprises a foot portion 9, 10 at each side wall 4, 5. The foot portion 9, 10 is rigidly connected to the side wall 4, 5 and protruding away from the space 6. The foot portions 9, 10 are also provided with a plurality of through-holes 11, 12 for the passage of fresh concrete to the lower side of the foot portions 9, 10, particularly when the foot portions are adjusted so as to be kept at a distance above the foundation. It will be understood that the holes 7, 8, 9, 10 result in considerable saving in material and reduced weight. However, the greatest reduction in weight of the supporting elements is achieved thanks to the space 6.

The supporting element, or more precisely supporting and levelling element, is preferably produced from a flat sheet-metal blank which is bent so that the foot portions 9, 10 and side walls 4, 5 are connected at the folding lines between them. The junction or ridge 13 between the side walls 4, 5 can ce designed in various ways, itself forming either the whole top member 2, or a part of this. In the embodiments shown the ridge 13 forms a part of the top member 2 which thus includes a second part in the form of a form stable body 14 forming a rail, said body being disposed above and anchored firmly to the ridge 13.

In the embodiment shown in FIGS. 1 and 2 this is achieved by the ridge 13 being formed with an upwardly directed flange 15, while the rail 14 is provided with a corresponding groove 16 to receive the flange 15, thus securing the rail 14 to the ridge 13. The rail 14 may be detachably joined to the ridge 13, which is advantageous in the case when the rail 14 is to be removed after casting.

Figure 3:
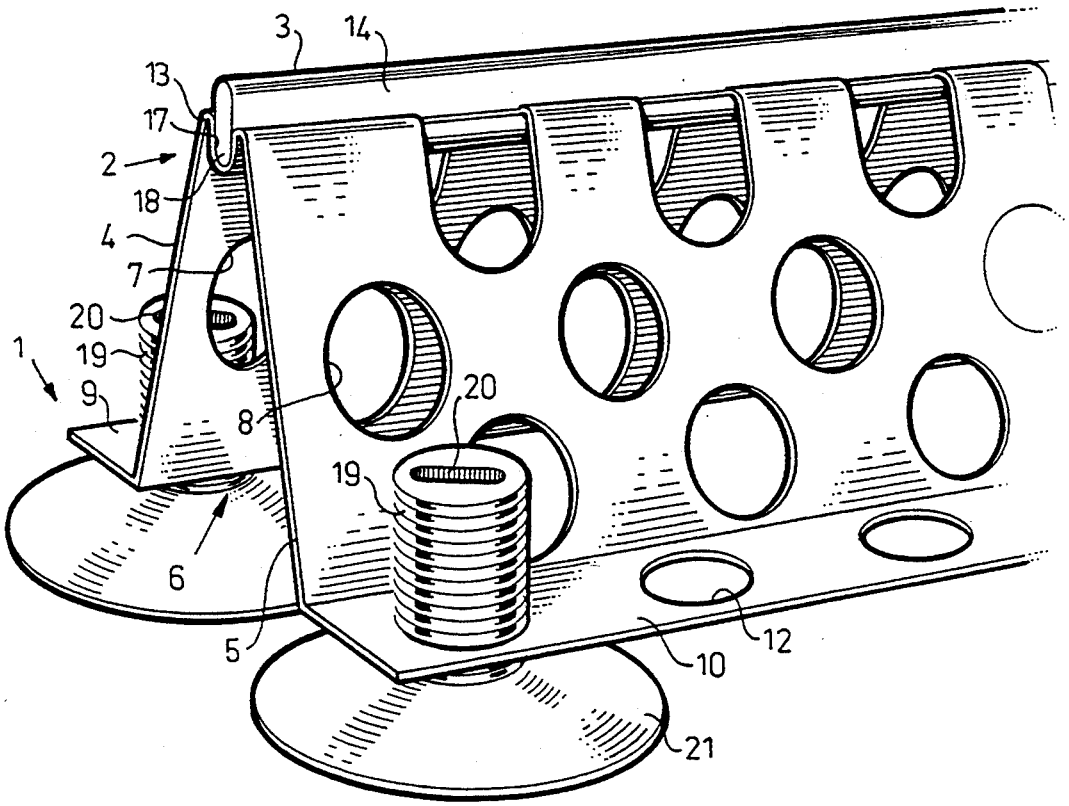
FIG. 3 is a perspective view of a supporting element according to a second embodiment of the invention.
Figure 4:
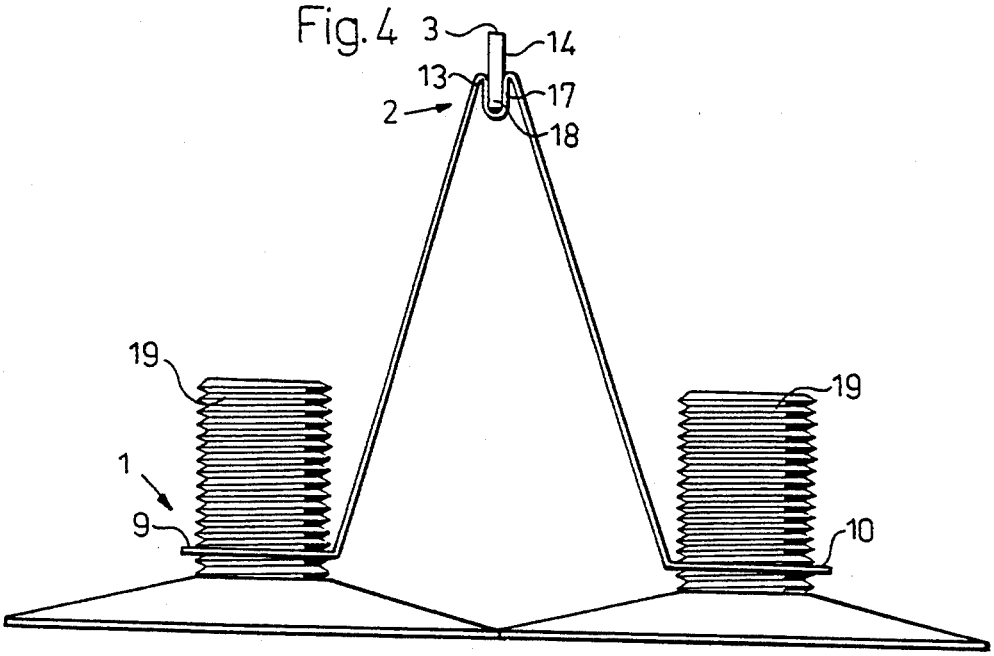
FIG. 4 is an end view of the supporting element according to FIG. 3.

In the embodiment shown in FIGS. 3 and 4 the ridge 13 of the top member 2 is formed with a longitudinal groove 17, in which case the body 14 of the top member 2 is provided with a lower portion 18 having a thickness corresponding to the width of the groove 17, permitting the rail 14 to be mounted into the groove 17 and retained therein to give a firm engagement. This embodiment can be used advantageously for casting in two steps, the supporting element shown in FIGS. 3 and 4 being positioned for casting a first, thicker layer of concrete and an elevating rail (not shown) then being applied on top of the supporting element. Such an elevating rail may be designed as the rail 14 in FIGS. 1 and 2 and forms a second sliding plane surface located at a predetermined distance, e.g. 10 mm, above the first sliding plane surface 3. A top layer of hard concrete is thereafter applied and levelled, having a thickness thus corresponding to said distance, i.e. 10 mm in the example given.

Figure 8:
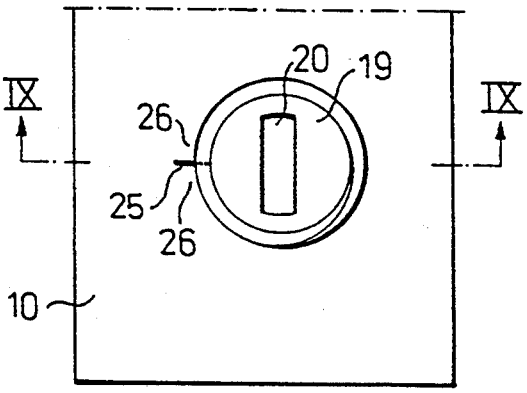
FIG. 8 is a view from above of part of a foot portion with screw, of the supporting element according to FIGS. 3 and 4.
Figure 9:
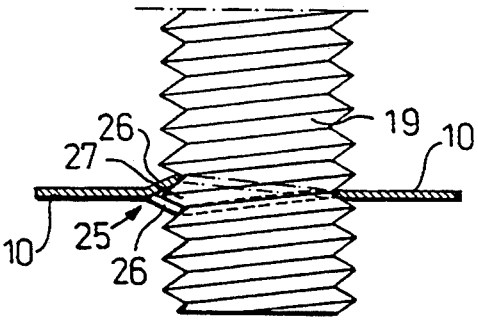
FIG. 9 is a section along the line IX—IX in FIG. 8.

The supporting element according to the invention preferably also includes means for adjusting the sliding plane surface 3 to bring it to the desired level for the concrete-levelling device. Such level-adjustment means preferably consist of screws 19, each with a shaft corresponding to the size of the holes 11, 12 in the foot portions 9, 10 so that the screws 19 can be brought into thread engagement with the edges of the holes as shown in FIGS. 3 and 4. By turning the screws 19 in one direction or the other, the vertical position of the supporting element can be quickly and easily adjusted. To facilitate screwing the screws 19 may be provided with an engagement means for a turning member, e.g. a hole 20 in the upper end of the screw with rectangular cross section. The holes, or the selected holes 11, 12, every fourth hole, designed for screws 19 may advantageously be shaped so that the edge of the hole corresponds to the thread pitch of the screw 19. This is easily achived by a slit 25 being made in the edge portion 26 of the hole, as illustrated in FIGS. 8 and 9, the length of the slit 25 being slightly greater than the depth of the screw thread. The edge portion 26 of the hole on each side of the slit 25 is bent apart to form a groove 27 close to the slit 25 which corresponds substantially to the screw thread, the bending incline decreasing to zero at the diametrically opposite side of the hole edge as illustrated in FIG. 9. In the case of hard foundations such as ceilings it is sufficient for the lower ends of the screws, possibly provided with a small support head, to rest against the foundation. When the foundation is the ground it is advisable for the screw 19 to be placed on a separate supporting plate 21 as shown in FIGS. 3 and 4. Instead of using screws and support plates, concrete spots may be placed out on the foundation in conventional manner if it consists of ground or casettes, in which concrete spots the supporting elements are adjusted to the correct level. When the foundation consists of ceilings or casettes special plastic spacers may be used to bring the supporting element and trussing irons to the desired level.

Special locking means may be used to prevent the side walls 4, 5 from being forced apart, such as clamps 22 which are secured to and extend between the foot portions 9, 10 as shown in FIGS. 1 and 2.

In the embodiments shown the holes 7, 8 are arranged in three separate rows in each side wall 4, 5. This offers great freedom when mounting the trussing irons.

In the embodiment shown in FIGS. 1 and 2 a barrier member for the concrete is arranged in the space 6, a curtain 23 of flexible material as shown in FIG. 2, which is secured at its upper edge to the inside of the ridge 13, the other edge being free and extending to the level of the foot portions 9, 10. The curtain 23 thus hangs freely in the space 6. When a floor is being casted in compartments the curtain 23 prevents concrete entering through one of the side walls 4 or 5 from flowing out through the other side wall 5 or 4, respectively since the concrete flowing into the space 6 presses the curtain 23 into contact with the inside of the other side wall 5 or 4, respectively, thus closing the holes 8 or 7, respectively. Any unfilled spaces in the space 6 will be filled with concrete when casting is performed on the other side of the supporting element in the adjacent compartment.

Figure 5:
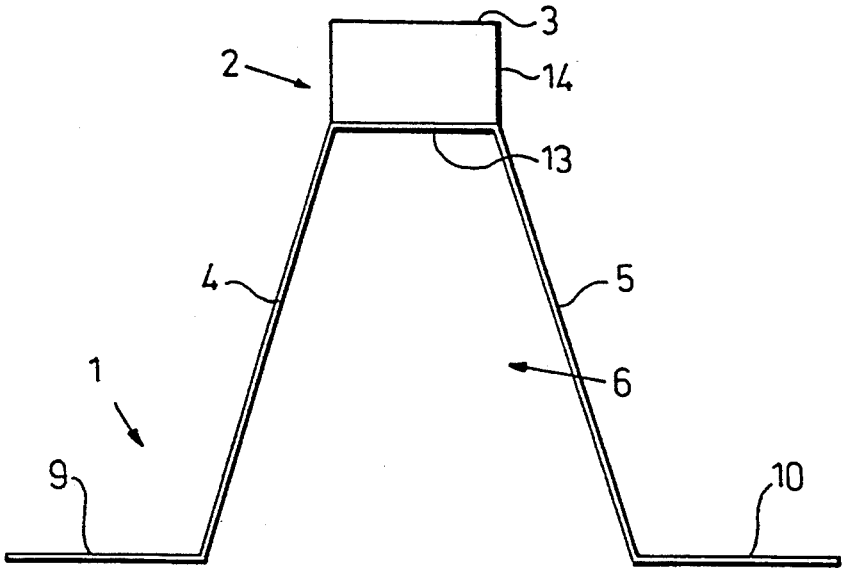
FIGS. 5–7 are end views of supporting elements according to three further embodiments of the invention.

In the embodiment shown in FIG. 5 the ridge 13 has a flat, horizontal surface and the form stable body 14 forming the rail has a correspondingly flat surface enabling it to be anchored by means of a suitable adhesive, for instance.

Figure 6:
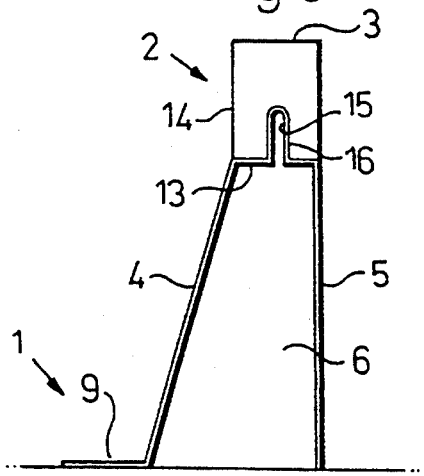

In the embodiment shown in FIG. 6 one side wall 4 is inclined and provided with holes 7 as described above, the other side wall 5 being vertical and more over has no holes. This supporting element forms a barrier and prevents concrete from running from one side to the other. It can be used against a wall, for instance, in which case the unperforated side wall 5 should face the wall. The side wall 5 in this embodiment may be covered by a material, e.g. a soft or insulating material, in order to suppress sound in the frame when the supporting element is placed against a wall. The vertical side wall 5 need not have a foot portion.

Figure 7:
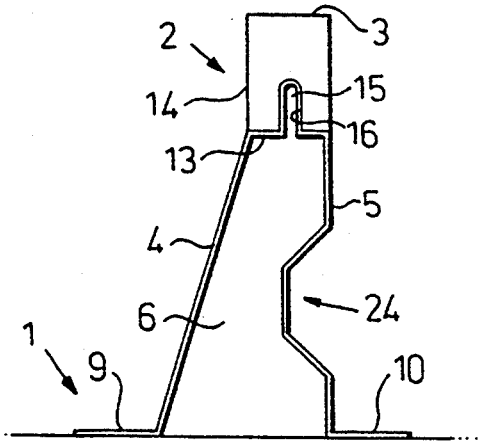

In the embodiment according to FIG. 7 one side wall 4 is inclined and the other is vertical. Both side walls 4, 5 are provided with holes 7, 8 as described above. The vertical side wall 5 has a recess at its mid-section so that a longitudinal groove 24 is formed. This groove 24 is filled with concrete so that the finished concrete floor has a corresponding protuberance and the groove 24 and this protuberance form in situ a tongue and groove joint, thereby preventing vertical displacement of the concrete floor at the joint. According to an alternative embodiment (not shown) the vertical side wall 5 is provided with a corresponding protuberance instead of the groove and an equivalent tongue and groove joint is thus obtained at casting.

The supporting element comprising foot portions 9, 10, side walls 4, 5 and ridge 13 may be made of plastic, metal such as steel or expanded metal, wood, wire-netting of sufficient thickness (rigid), or concrete. The body 14 forming a rail may consist of plastic, wood or metal, for instance. When the rail 14 is detachable it may be removed, if desired, when the concrete floor has solidified, in which case the groove thus obtained in the floor is filled with suitable jointing compound used for wear floors.

Since the side walls 4, 5 incline outwardly from the top member the concrete can more easily flow in trough the holes. The inclined side walls 4, 5 suitably form an acute angle of 25°–90°, preferably 30°–60°, with each other.

I claim:

1. A supporting element with elongate form for use in casting concrete floors on a foundation, comprising:

a base member;

a top member mounted on said base member and having a sliding plane surface to allow a concrete-leveling device to be moved along the sliding plane surface;

said base member comprising two longitudinal, form stable side walls spaced from each other to define a longitudinal space between them, a central top portion formed between said side walls, said central top portion supporting said top member thereon, said side walls each making approximately the same angle with respect to said top member, and said wide walls being inclined so that they form an angle of about 25°–90° with respect to each other; and at least one of the side walls including means defining a plurality of through-extending holes positioned to permit fresh concrete to flow therethrough into said longitudinal space during said casting, so that the longitudinal space substantially fills with concrete.

2. A supporting element as recited in claim 1 further comprising a flexible material curtain extending downwardly from said top member and substantially bisecting said longitudinal space.

3. A supporting element as recited in claim 1 further comprising feet portions extending outwardly from portions of said walls opposite said top member, and a clamp means for connecting said feet portions together.

4. A supporting element as recited in claim 1 wherein said base member has an upwardly protruding flange on a top portion thereof, and wherein said top member has means defining a recess in a bottom portion thereof substantially matching said upwardly protruding flange; and wherein said top member recess receives said upwardly protruding flange.

5. A supporting element for use in casing concrete floors on a foundation, comprising:

an elongated base member having first and second side walls defining between them a longitudinal volume, and a central top portion between said side walls, at least one of said side walls having through extending openings therein positioned and dimensioned to permit fresh concrete to flow therethrough into said longitudinal volume during casting to fill said longitudinal volume with concrete; and an elongated top member distinct from said base member, said top member supported by said base member at said central top portion between said walls and extending upwardly from said base member, said top member having an elongated top sliding plane surface allowing a concrete levelling device to be moved therealong.

6. A supporting element as recited in claim 5 wherein said top member is removably connected to said base member.

7. A supporting element as recited in claim 5 wherein said top member is plastic and said base member is metal.

8. A supporting element as recited in claim 7 wherein said base member comprises a unitary piece of metal.

9. A supporting element as recited in claim 7 wherein said side walls each are angled with respect to said top member, forming substantially the same angle with respect to a plane extending through said top member and said central top portion, and said longitudinal volume, and wherein said through extending openings are provided in both said side walls.

10. A supporting element as recited in claim 9 wherein said base member comprises a groove formed in said central top portion, and wherein said top member comprises an elongated rail received within said groove.

11. A supporting element as recited in claim 7 wherein said base member comprises a groove formed in said central top portion, and wherein said top member comprises an elongated rail received within said groove.

12. A supporting element as recited in claim 5 wherein said base member comprises a groove formed in said central top portion, and wherein said top member comprises an elongated rail received within said groove.

13. A supporting element as recited in claim 5 further comprising a flexible barrier disposed in said longitudinal volume, and supported at said central top portion of said base member to extend into said longitudinal volume.

14. A supporting element as recited in claim 5 further comprising a foot portion connected to each of said side walls remote from said base member central top portion, each of said foot portions having openings therein for receipt of level adjustment screws; and a plurality of level adjustment screws in operative engagement with at least some of said openings of each of said foot portions.

15. A supporting element as recited in claim 14 further comprising a supporting element connected to each of said level adjustment screws on the opposite side of said foot portion from said central top portion of said base member.

16. A supporting element as recited in claim 5 further comprising a foot portion connected to each of said side walls remote from said base member central top portion, and a plurality of clamp elements in engagement with opposing foot portions to clamp said side walls in predetermined position with respect to each other.

17. A supporting element for use in casing concrete floors on a foundation, comprising:

an elongated base member having first and second side walls defining between them a longitudinal volume, and a central top portion between said side walls, at least one of said side walls having through extending openings therein positioned and dimensioned to permit fresh concrete to flow therethrough into said longitudinal volume during casting to fill said longitudinal volume with concrete;

an elongated top member supporting by said central top portion and having an elongated top sliding plane surface allowing a concrete levelling device to be moved therealong;

a foot portion connected to each of said side walls remote from said base member central top portion, each of said foot portions having openings therein for receipt of threaded level adjustment screws; and a plurality of threaded level adjustment screws in operative engagement with at least some of said openings of each of said foot portions, for adjusting the position of said top sliding plane surface.

18. A supporting element as recited in claim 17 further comprising a supporting element connected to each of said level adjustment screws on the opposite side of said foot portion from said central top portion of said base member.

19. A supporting element as recited in claim 17 wherein said openings in each of said foot portions for receipt of level adjustment screws have edges, and wherein said edges are shaped so that said edges correspond to a thread pitch of said level adjustment screws.

20. A supporting element as recited in claim 19 wherein a slit is provided in an edge portion of each of said foot portion openings for receipt of a threaded level adjustment screw, the length of said slit being slightly greater than the depth of a screw thread of a said threaded level adjustment screw; and wherein a part of said edge portion of each side of said slit is bent apart in opposite directions to receive a screw thread of a said level adjustment screw therebetween, and the part of said edge portion diametrically opposite said slit not bent.

21. A supporting element for use in casing concrete floors on a foundation, comprising:

an elongated base member having first and second side walls defining between them a longitudinal volume, and a central top portion between said side walls, at least one of said side walls having through extending openings therein positioned and dimensioned to permit fresh concrete to flow therethrough into said longitudinal volume during casting to fill said longitudinal volume with concrete;

an elongated top member having an elongated top sliding plane surface allowing a concrete levelling device to be moved therealong; and a flexible barrier disposed in said longitudinal volume, and supported at said central top portion of said base member to extend into said longitudinal volume.

22. A supporting element as recited in claim 21 wherein said side walls each are angled with respect to said top member, forming substantially the same angle with respect to a plane extending through said top member and said central top portion, and said longitudinal volume, and wherein said through extending openings are provided in both said side walls.

* * * * *